US007252261B2

(12) United States Patent
Rollins et al.

(10) Patent No.: US 7,252,261 B2
(45) Date of Patent: Aug. 7, 2007

(54) ULTRA-LIGHT PNEUMATIC LEAF EXPANDING SHAFT

(75) Inventors: James W. Rollins, Winsted, CT (US); Robert C. Smith, Watertown, CT (US)

(73) Assignee: Goldenrod Corporation, Beacon Falls, CT (US)

( * ) Notice: Subject to any disclaimer, the term of this patent is extended or adjusted under 35 U.S.C. 154(b) by 143 days.

(21) Appl. No.: 10/817,142

(22) Filed: Apr. 5, 2004

(65) Prior Publication Data

US 2004/0195428 A1 Oct. 7, 2004

Related U.S. Application Data

(60) Provisional application No. 60/460,424, filed on Apr. 7, 2003.

(51) Int. Cl.
*B65H 75/24* (2006.01)

(52) U.S. Cl. ..... 242/571.1; 242/571.2; 492/4

(58) Field of Classification Search ..... 242/571.1, 242/571.2; 492/4
See application file for complete search history.

(56) References Cited

U.S. PATENT DOCUMENTS

| | | | | |
|---|---|---|---|---|
| 2,911,795 | A | | 11/1959 | Cobi |
| 3,006,152 | A | | 10/1961 | Rusche |
| 3,025,071 | A | | 3/1962 | Larrad |
| 3,188,017 | A | | 6/1965 | Orton, Jr. |
| 3,273,817 | A | | 9/1966 | Damiron |
| 3,414,210 | A | * | 12/1968 | Gaudin ..... 242/571.2 |
| 4,101,085 | A | * | 7/1978 | Arno ..... 242/571.2 |
| 4,279,386 | A | | 7/1981 | Lobo et al. |
| 4,342,433 | A | | 8/1982 | Mastriani |
| 4,771,962 | A | * | 9/1988 | Gavin et al. ..... 242/521 |
| 4,854,520 | A | * | 8/1989 | Gavin et al. ..... 242/530.3 |
| 5,372,331 | A | * | 12/1994 | Miller et al. ..... 242/571.2 |
| 5,445,342 | A | | 8/1995 | Miller et al. |
| 5,480,022 | A | * | 1/1996 | Matsuda et al. ..... 198/782 |
| 5,509,618 | A | | 4/1996 | Kleiman et al. |
| 5,597,134 | A | | 1/1997 | Marin |
| 5,690,300 | A | * | 11/1997 | Iannucci ..... 242/571.2 |
| 5,746,386 | A | | 5/1998 | Marin |
| 6,065,715 | A | * | 5/2000 | Andersson ..... 242/571.1 |
| 6,196,494 | B1 | | 3/2001 | Rollins et al. |

* cited by examiner

*Primary Examiner*—Gene O. Crawford
*Assistant Examiner*—Sang Kim
(74) *Attorney, Agent, or Firm*—Ware, Fressola, Van der Sluys & Adolphson LLP

(57) ABSTRACT

A generally cylindrical expansible shaft includes an outer profile, and a generally cylindrical inner body having a longitudinal axis and at least one first coupling element. At least two semi-circular leaf elements may be movably coupled to the first coupling element of the inner body by means of at least one second coupling element. The leaf elements may together substantially form the outer profile of the generally cylindrical expansible shaft. At least one thrusting element may be operatively disposed between the leaf elements and the inner body to move the leaf elements radially outwards relative to the longitudinal axis to increase an outer diameter of the shaft when in a first configuration, and allow the leaf elements to move radially inwards relative to the longitudinal axis to decrease the outer diameter of the shaft when in a second configuration.

21 Claims, 8 Drawing Sheets

10
12
14
15
16
18
22
24
26
28
30
32
34
36
42
52
60
A
56
58
62
64
66
68
74
80
81
82
84
86
88
90
92
94
96
102
104
106
108
110
112

ULTRA-LIGHT PNEUMATIC LEAF EXPANDING SHAFT

RELATED APPLICATIONS

This application claims benefit of priority of Provisional Application Ser. No. 60/460,424 filed on Apr. 7, 2003.

BACKGROUND OF INVENTION a. Field of Invention

The invention relates generally to an expanding shaft, and, more particularly to an expanding shaft of the type which carries tubular supports on which strips of plastic, aluminum or paper films are wound or from which the strips are unwound.

b. Description of Related Art

During the manufacture of plastic, aluminum, paper or other sheet products, the sheet material is typically wound onto, or unwound from, a tubular core supported by a diametrically expansible shaft which is inserted into the core and expanded to grip the core frictionally. Such shafts are typically used when slitting a wide web of material into discrete widths and rewinding the material on the core. Conventional expansible roll core shafts typically employ a large number of relatively small, separate core-engaging elements expansible by a common internal air-expandable bladder, or by a plurality of individually controllable air-expandable bladders.

Of known varieties of expansible shafts, as disclosed in U.S. Pat. No. 3,904,144, the disclosure of which is incorporated herein by reference, one type of shaft includes straight, parallel slots cut longitudinally in the periphery thereof. The slots include straight, separate, air-expandable, resilient bladders overlain by respective straight core-contacting elements which extend throughout the length of the shaft. One key drawback in such a shaft is in the overall ability to evenly load delicate cores to eliminate core distortion or damage, and the overall excessive weight of such shafts, which requires the implementation of special handling procedures and methods, and thus increases the overall manufacturing and operational costs for such shafts.

Other known varieties of expansible shafts include the shaft designs disclosed in U.S. Pat. Nos. 5,597,134 and 5,746,386, the respective disclosures of which are incorporated herein by reference.

The expansible shafts disclosed in the '134 and '386 patents disclose the use of mobile means mounted for radial movement within slots in the expanding shaft. Core stops are adjustably mounted for axial movement longitudinally of at least one of the mobile means to vary the spacing of the core stops longitudinally of the shaft as desired. Locking means is provided for locking the core stops in position axially of the mobile means and the shaft. With the arrangement as shown in the '134 and '386 patents, the longitudinal position of the core stops relative to the shaft can be adjusted while the shaft is mounted on a slitter-rewinder machine. However, due to the weight of the shaft and associated components, it generally takes a significant amount of labor and down time of the machine while such changes are made.

While the expansible shaft disclosed in U.S. Pat. No. 6,196,494, which is owned by the assignee herein and the disclosure of which is incorporated herein by reference, provided significant improvement in the construction of an expansible shaft over the shafts disclosed in the '134 and '386 patents so as to permit the slit widths on a slitter-rewinder machine to be changed in a minimum amount of time, there remains a need for an improved expansible shaft having a reduced overall weight for further facilitating the overall manufacturing and operational costs thereof. There also remains a need for an improved expansible shaft which enables the application of higher torsional loads, and improved core loading for eliminating core distortion or damage, and an expansible shaft which is easier to assemble and disassemble, which includes a limited number of required components for ease of operability as well as for increased reliability and robustness of design, and which is economically feasible to manufacture.

SUMMARY OF INVENTION

The invention solves the problems and overcomes the drawbacks and deficiencies of prior expansible shaft designs by providing an improved expansible shaft having exemplary objectives of a reduced overall weight for facilitating the overall manufacturing and operational costs thereof, a shaft which is capable of application of higher torsional loads, and includes improved core loading for eliminating core distortion or damage.

The present invention achieves the aforementioned exemplary objectives by providing a generally cylindrical expansible shaft having an outer profile. The shaft includes a generally cylindrical inner body having a longitudinal axis and at least one first coupling element. At least two arcuate leaf elements may be movably coupled to the first coupling element of the inner body by means of at least one second coupling element. The leaf elements may together substantially form the outer profile of the generally cylindrical expansible shaft. At least one thrusting element may be operatively disposed between the leaf elements and the inner body to move the leaf elements radially outwards relative to the longitudinal axis to increase an outer diameter of the shaft when in a first configuration, and allow the leaf elements to move radially inwards relative to the longitudinal axis to decrease the outer diameter of the shaft when in a second configuration.

For the expansible shaft described above, the leaf elements may be resiliently biased radially inwards by means of a spring disposed between the inner body and the leaf elements. The spring may be either a leaf, wave or a coil spring. The first and second coupling elements may be complementary hooks. In a particular embodiment disclosed, the shaft may include two first and two second coupling elements, and three arcuate leaf elements. The leaf elements may include a plurality of knurls on an outer surface for increasing friction of engagement with a core of a product to be gripped. The expansible shaft may further include an air journal removably coupled with the inner body and including an intake opening for permitting air to be supplied to the thrusting element for moving the leaf elements to the first configuration. The air journal may further include an exit opening for permitting air to be removed from the thrusting element for moving the leaf elements to the second configuration. The air journal may also include a keyed and/or a slotted locking member engageable with the inner body for imparting rotational torque transmission to the shaft, and a keyed and/or a slotted locking member engageable with a journal end connectable to a drive unit for driving the shaft for imparting rotational torque transmission to the shaft.

The invention yet further provides an expansible shaft having an outer profile. The shaft may include an inner body having a longitudinal axis and at least one first coupling element, and at least two leaf elements movably coupled to the first coupling element of the inner body by means of at least one second coupling element. The leaf elements together substantially form the outer profile of the generally cylindrical expansible shaft. At least one thrusting element may be operatively disposed between the leaf elements and the inner body to move the leaf elements radially outwards relative to the longitudinal axis to increase an outer surface area of the shaft when in a first configuration, and allow the leaf elements to move radially inwards relative to the longitudinal axis to decrease the outer surface area of the shaft when in a second configuration.

For the expansible shaft described above, the leaf elements may be resiliently biased radially inwards by means of a spring disposed between the inner body and the leaf elements. The spring may be either a leaf, wave or a coil spring. The first and second coupling elements may be complementary hooks. In a particular embodiment disclosed, the shaft may include two first and two second coupling elements, and three leaf elements. The leaf elements may include a plurality of knurls on an outer surface for increasing friction of engagement with a core of a product to be gripped. The shaft may further include an air journal removably coupled with the inner body and including an intake opening for permitting air to be supplied to the thrusting element for moving the leaf elements to the first configuration. The air journal may further include an exit opening for permitting air to be removed from the thrusting element for moving the leaf elements to the second configuration. The air journal may also include a keyed and/or a slotted locking member engageable with the inner body for imparting rotational torque transmission to the shaft, and a keyed and/or a slotted locking member engageable with a journal end connectable to a drive unit for driving the shaft for imparting rotational torque transmission to the shaft.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
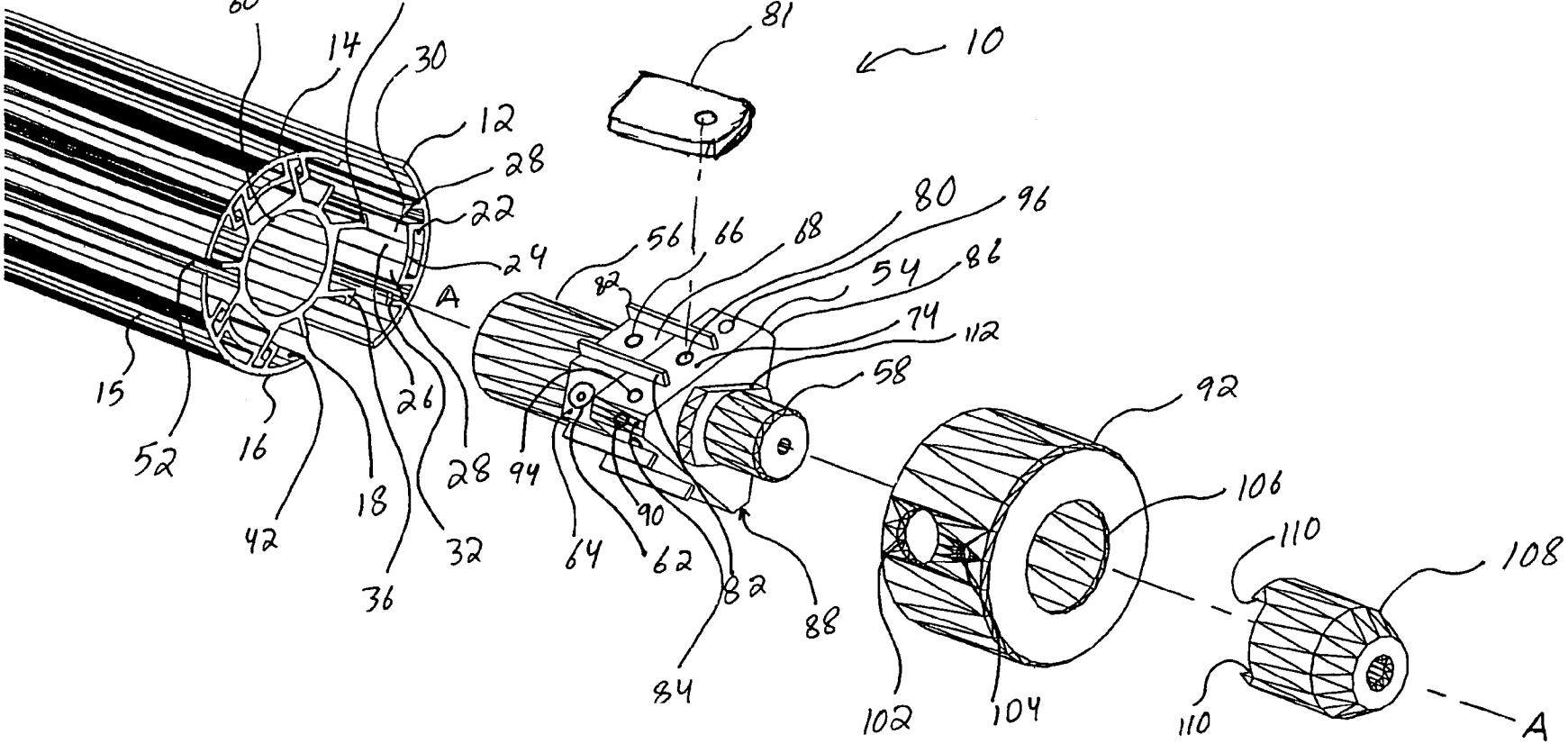
FIG. 1 is an exploded isometric view of an expansible shaft according to the present invention, illustrating various components in their disassembled configuration.

Referring now to the drawings wherein like reference numerals designate corresponding parts throughout the several views, FIGS. 1-19 illustrate an expansible shaft according to the present invention, generally designated 10.

Figure 19:
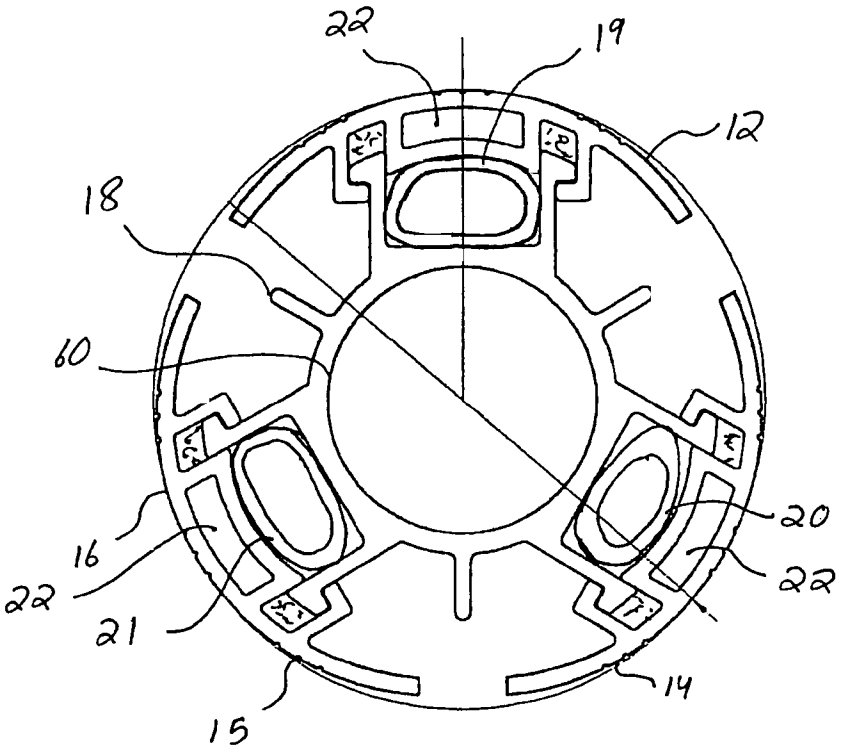
FIG. 19 is an illustrative view of the expansible shaft of FIG. 1, illustrating the location of the thrusting means and the leaf retract springs, with the thrusting means disposed in the expanded configuration.
Figure 18:
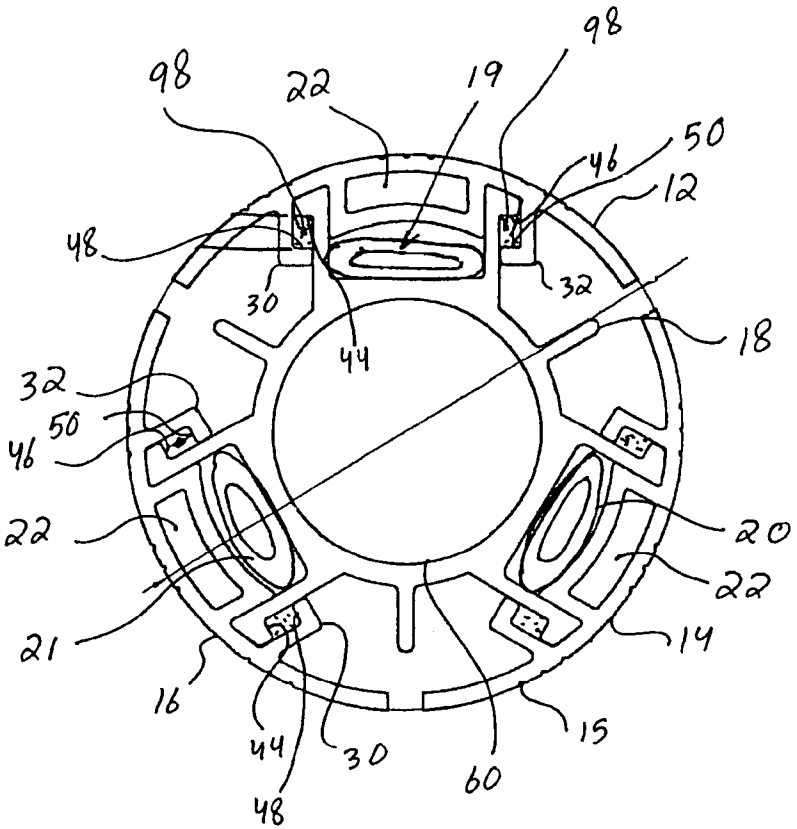
FIG. 18 is an illustrative view of the expansible shaft of FIG. 1, illustrating the location of the thrusting means and the leaf retract springs, with the thrusting means disposed in the contracted configuration.

As shown in FIGS. 1-3 and 8-9, expansible shaft 10 may generally include a longitudinal axis A-A and leaves 12, 14, 16, coupled with inner body 18 and movable radially outwardly with respect to body 18 by means of thrusting means 19, 20, 21 (FIGS. 18-19). For the exemplary embodiment disclosed, it should be noted that although three leaves 12, 14, 16 are shown, the present invention may employ two or more leaves so long as the leaves form a generally cylindrical expansible shaft or form the outer profile of a non-cylindrical shaft when coupled with inner body 18. Each leaf 12, 14, 16 may include a generally arcuate cross-section having a hollowed cavity 22 disposed generally centrally along the length thereof. The outer surface of each leaf 12, 14, 16 may be formed of a suitable friction material and include longitudinally extending knurls 15 for facilitating retention of a core and the like during driving or braking of shaft 10. Hollow cavity 22 may include a bottom surface 24 having a central flat face 26 and mirror-image tapered surfaces 28 disposed adjacent flat face 26 for facilitating uniform expansion of thrusting means 19, 20, 21.

Still referring to FIGS. 1-3 and 8-9, each leaf 12, 14, 16 may further include mirror-image longitudinally extending hook members 30, 32 respectively engageable and retainable with complementary mirror-image longitudinally extending hook members 34, 36 of inner body 18. The top faces 38, 40 of each complementary hook member 34, 36 may be rounded for complementary engagement with internal wall 42 of leaves 12, 14,16. The bottom faces 44, 46 of each hook member 34, 36 may be machined or otherwise formed for complementary engagement with the surface of leaf shaft retract springs 98, as illustrated in FIGS. 18 and 19. Each pair of hook members 34, 36 define longitudinally extending walls of a longitudinally extending channel therebetween. Thrusting means 19, 20, 21 may each comprise tubes which receive air pressure therein in a well-known manner to respectively expand and force leaves 12, 14, 16 radially outwardly with respect to body 18. The thrusting means 19, 20, 21 are operatively disposed in the longitudinally extending channels formed between the hook members 34, 36. As shown in FIG. 1, each leaf 12, 14, 16 may include a predetermined gap 52 between each adjacent leaf when coupled to inner body 18 for permitting uniform expansion and contraction thereof relative to inner body 18.

Referring next to FIGS. 1, 4-7, 18 and 19, expansible shaft 10 may include air journal 54 having a first diameter shaft 56 at one end thereof and a second smaller diameter shaft 58 at the other end thereof. The diameter of shaft 56 may be sized for insertion into hollow opening 60 provided in inner body 18. Air journal 54 may include an air valve connection 62 provided on face 64 for connection to a suitable air supply (not shown) for providing air to thrusting means 19, 20, 21 through suitable openings 66 provided on thrust faces 68, 70, 72. Faces 74, 76, 78 of air journal 54 may each include suitable openings 80 for attachment of top plate 81 for securing thrusting means 19, 20, 21 in place. Suitable valve means (not shown) may be provided for controlling the passage of air into openings 66 from air valve connection 62 for expansion of thrusting means 19, 20, 21 (see FIG. 19), and out through valve connection 62 for contraction of thrusting means 19, 20, 21 (see FIG. 18). Each face 68, 70, 72 (and adjacent faces 74, 76, 78) may include a pair of longitudinally protruding ribs 82 for generally controlling and guiding lateral expansion of thrusting means 19, 20, 21.

Figure 12:
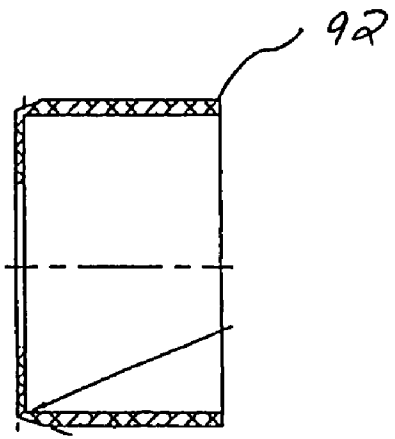
FIG. 12 is a cross-sectional view of the leaf ring of FIG. 10, taken generally along line 12-12 in FIG. 10.
Figure 10:
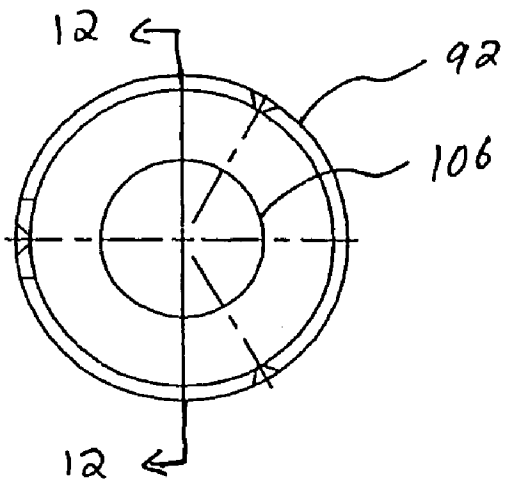
FIG. 10 is a front view of a leaf ring of the expansible shaft of FIG. 1.
Figure 11:
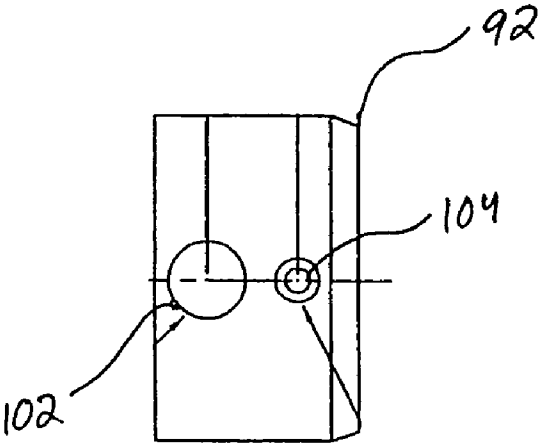
FIG. 11 is a right side view of the leaf ring of FIG. 10.
Figure 15:
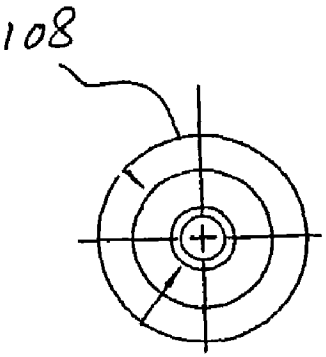
FIG. 15 is a front view of the journal end of FIG. 13.
Figure 13:
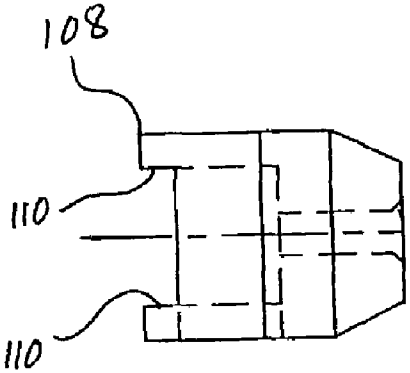
FIG. 13 is a right side view of a journal end of the expansible shaft of FIG. 1.
Figure 14:
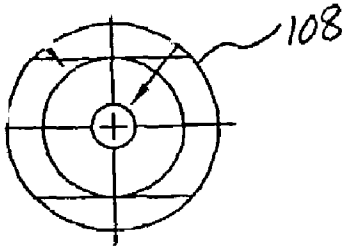
FIG. 14 is a rear view of the journal end of FIG. 13.

Still referring to FIGS. 1 and 4-7, air journal 54 may include three symmetrically disposed retention faces 84, 86, 88 each including internally threaded holes 90 for permitting removable retention of leaf ring 92 (FIGS. 10-12). Faces 74, 76, 78 adjacent retention faces 84, 86, 88 may each include a pair of internally threaded holes 94, 96 disposed on opposite ends of ribs 82 for permitting retention of leaf shaft retract springs 98, described in detail below. The internal area of shaft 56 may be hollowed as at 100 for reducing the overall weight of air journal 54.

Referring next to FIGS. 1 and 10-12, leaf ring 92 may generally include a circular cross-section complementary to the cross-section of expansible shaft 10 in its contracted configuration. Ring 92 may further include an opening 102 for permitting connection of an air supply hose (not shown) to air valve connection 62. Further openings 104 may be provided in circumferential alignment with holes 90 for permitting attachment of ring 92 to air journal 54 by suitable fasteners (not shown). A suitable opening 106 may be provided for insertion of journal end 108.

As shown in FIGS. 1 and 13-15, journal end 108 may be inserted through opening 106 and coupled with air journal 54. A suitable alignment channel formed by protrusions 110 may be engaged with alignment member 112 provided on air journal 54 for facilitating engagement, alignment and retention of journal end 108 onto air journal 54. Once protrusions 110 are aligned and engaged with alignment member 112, a suitable fastener (not shown) may be used to fixedly couple journal end 108 to air journal 54.

Figure 17:
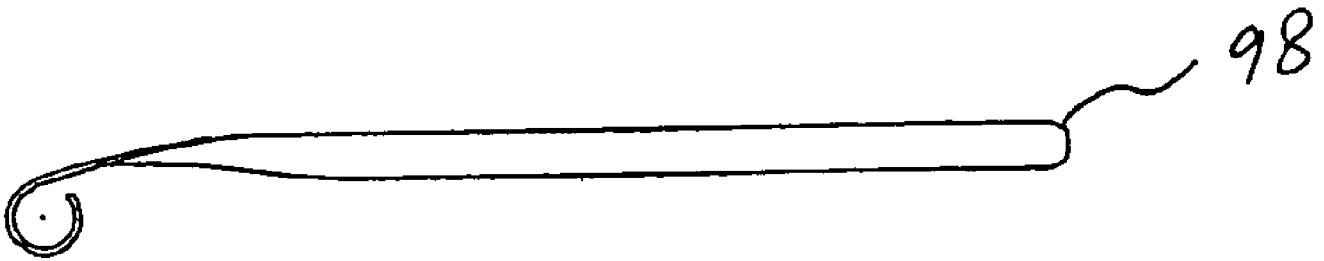
FIG. 17 is a top view of the leaf retract spring of FIG. 16.
Figure 16:
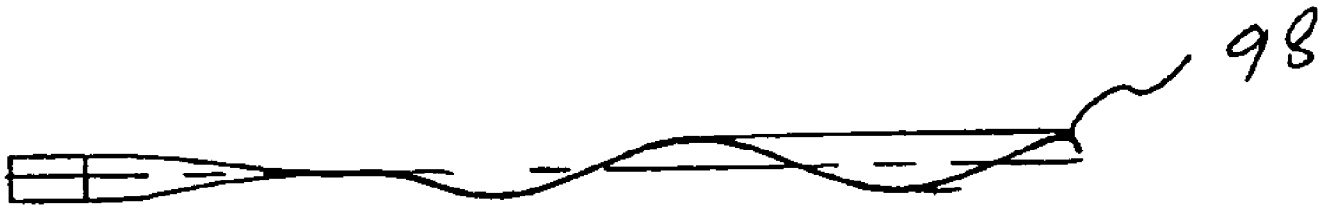
FIG. 16 is a side view of a leaf retract spring of the expansible shaft of FIG. 1.

Referring to FIGS. 1 and 16-17, as briefly discussed above, a pair of leaf shaft retract springs 98 may be respectively fastened to threaded holes 94, 96 disposed on opposite ends of ribs 82 on faces 74, 76, 78 of air journal 54 for resiliently biasing leaves 12, 14, 16 radially inwards for automatic retraction upon the release of air from thrusting means 19, 20, 21. Leaf shaft retract springs 98 may engage faces 48, 50 of hook members 30, 32 such that when thrusting means 19, 20, 21 are expanded (see FIG. 19), springs 98 are compressed to substantially flatten their profile, and upon the release of air pressure to contract thrusting means 19, 20, 21 (see FIG. 18), springs 98 return to their normal "wavy" profile. It should be noted that although wave springs have been disclosed herein, those skilled in the art would appreciate in view of this disclosure that coil or leaf springs may likewise be used. Moreover, for an extended length shaft, additional sets of leaf shaft retract springs 98 may be used at predetermined intervals along the shaft length for providing an adequate biasing force for retracting leaves 12, 14, 16.

The opposite end face of expansible shaft 10 may be closed off by a suitable journal similar to air journal 54, and a suitable ring and journal end 92, 108, respectively.

The various components described above for expansible shaft 10 may be formed by extrusion or machined, and may be formed of metal, plastic, fiber or composite material. The design, material selection, and fabrication of all components described above may be selected for minimizing the overall shaft weight and reducing machining and assembly time. The preferable material for the various components of shaft 10 may be aluminum and heat treated steel alloy for providing a strong interface between components, harder wear surfaces and optimal torque transmission from a drive unit (not shown) through the assembly of shaft 10.

Those skilled in the art would appreciate in view of this disclosure that various modifications may be made to expansible shaft 10 without departing from the scope of the present invention. For example, in addition to the various modifications discussed above, the overall outer surface profile of shaft 10 and therefore leaves 12, 14, 16 may be formed as needed (i.e. elliptical or other geometric shapes) for complementary engagement with a core to be gripped. Instead of the hook engagement means disclosed for coupling leaves 12, 14, 16 and inner body 18, other engagement means may be utilized for complementary engagement between coupling leaves 12, 14, 16 and inner body 18.

Figure 3:
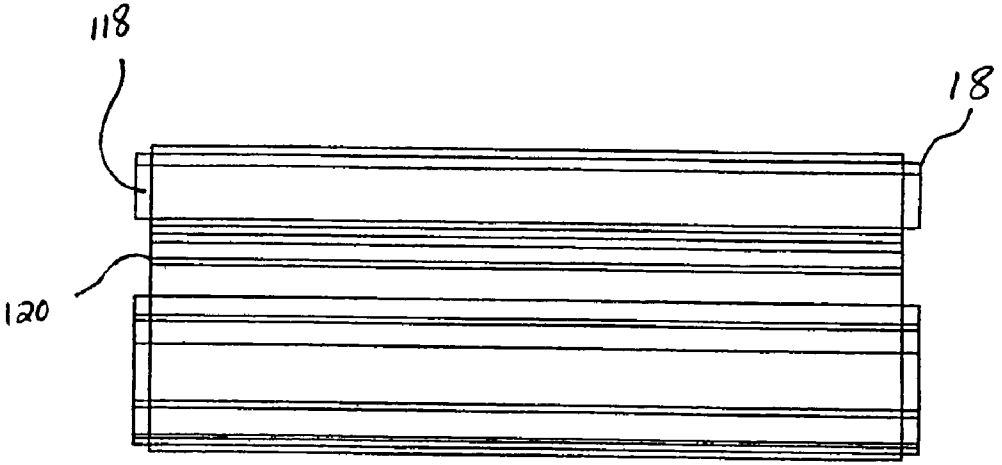
FIG. 3 is a right side view of the inner body of FIG. 2.
Figure 2:
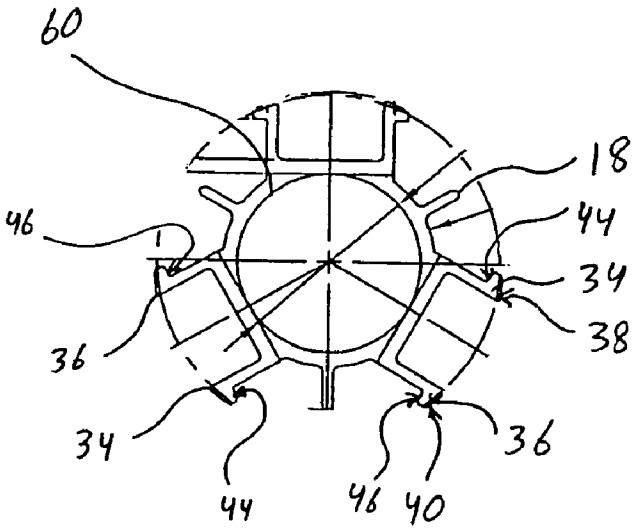
FIG. 2 is a front view of an inner body of the expansible shaft of FIG. 1.
Figure 6:
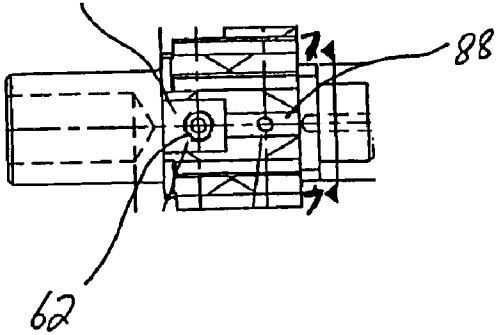
FIG. 6 is a right side view of the air journal of FIG. 4.
Figure 7:
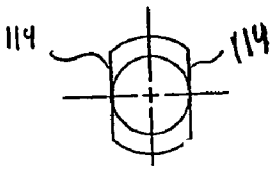
FIG. 7 is a cross-sectional view of the air journal of FIG. 4, taken generally along line 7-7 in FIG. 6.
Figure 4:
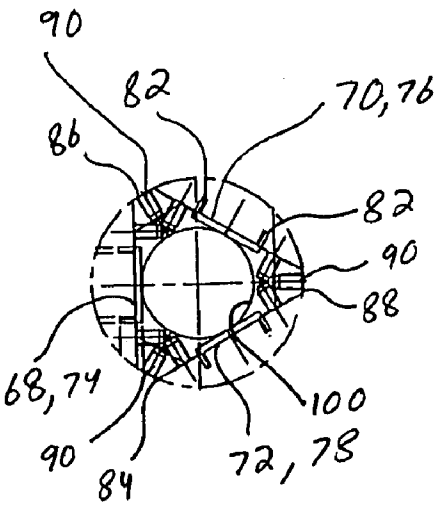
FIG. 4 is a front view of an air journal of the expansible shaft of FIG. 1.
Figure 5:
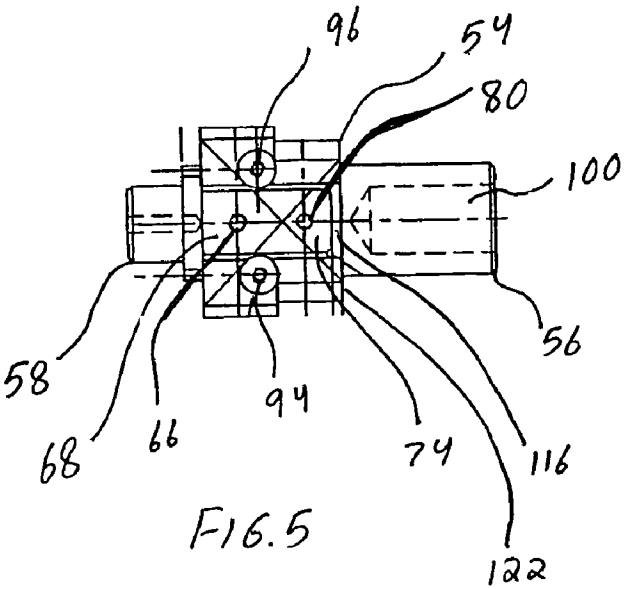
FIG. 5 is a left side view of the air journal of FIG. 4.
Figure 9:
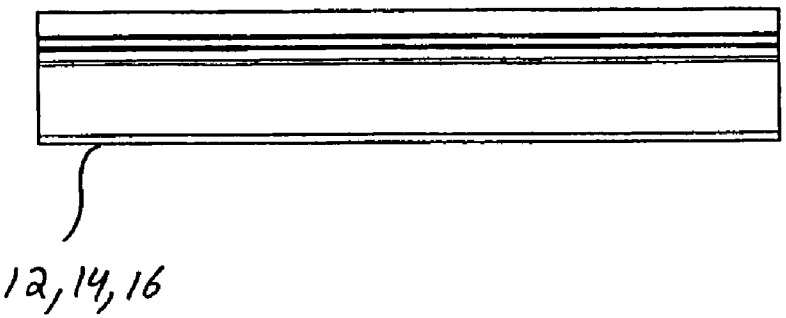
FIG. 9 is a right side view of the leaf of FIG. 8.
Figure 8:
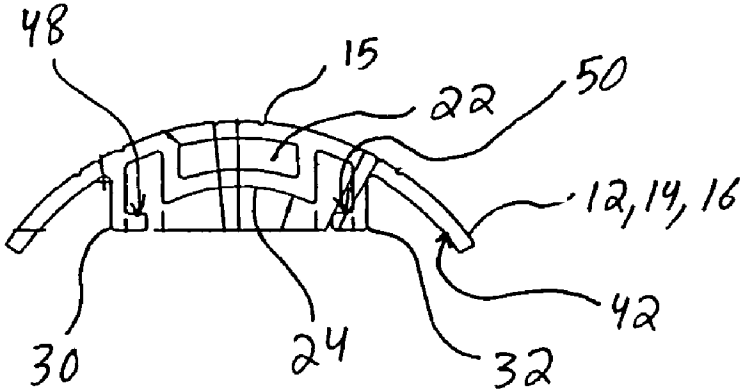
FIG. 8 is a front view of a leaf of the expansible shaft of FIG. 1.

Referring to FIGS. 3 and 5, for the expansible shaft 10 described above, air journal 54 may include a keyed or slotted locking feature defined by rectangular undercuts 116 adjacent the edges of faces 74, 76, 78. Upon assembly of air journal 54 with inner body 18, undercuts 116 are overlapped by protruding edges 118 of the three "U" shaped channels defined by hook members 34, 36 on inner body 18, such when journal 54 is coupled to inner body 18, protruding edges 118 rest within rectangular undercuts 116 and the surface edges along vertical plane 120 of inner body 18 contact the surface edges along vertical plane 122 of air journal 54. The aforementioned keyed or slotted locking feature between air journal 54 and inner body 18 provides improvement in rotational torque transmission and facilitates assembly alignment. Moreover, as shown in FIG. 7, air journal 54 may also include a keyed or slotted locking feature being drive flats 114 of alignment member 112 for engagement with protrusions 110 of journal end 108 for likewise improving rotational torque transmission and facilitating assembly alignment.

From the discussion above, the present invention provides an expansible shaft 10 which has been optimized in design for reducing operator handling issues due to reduced weight. Since rotational loads are inputted through symmetrically disposed hook elements, shaft 10 allows for higher torsional loads to be imparted during core gripping. Moreover, due to the uniform expansion and contraction characteristics of leaves 12, 14, 16, the leaves evenly load delicate material cores to eliminate core distortion or damage.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A generally cylindrical expansible shaft having an outer profile, said shaft comprising:

a generally cylindrical inner body having a longitudinal axis and at least one first coupling, each said at least one first coupling being at least one pair of spaced apart longitudinally extending hook elements, each pair defining longitudinally extending walls of a longitudinally extending channel therebetween;

at least two arcuate leaf elements being movably coupled to said at least one first coupling of said inner body by means of at least one second coupling, each said at least one second coupling being at least one pair of spaced apart longitudinally extending hook elements complementary to and cooperating with said spaced apart longitudinally extending hook elements of said at least one first coupling to limit radial movement of said at least two arcuate leaf elements relative to said generally cylindrical inner body, said at least two arcuate leaf elements together substantially forming said outer profile of said generally cylindrical expansible shaft; and at least one thrusting element being operatively disposed in each longitudinally extending channel and between said at least two arcuate leaf elements and said inner body to move said at least two arcuate leaf elements radially outwards relative to said longitudinal axis to increase an outer diameter of said shaft when in a first configuration and allow said at least two arcuate leaf elements to move radially inwards relative to said longitudinal axis to decrease said outer diameter of said shaft when in a second configuration.

2. A shaft according to claim 1, wherein said at least two arcuate leaf elements being resiliently biased radially inwards by means of at least one spring disposed between said inner body and said at least two arcuate leaf elements.

3. A shaft according to claim 2, wherein each said spring being one of a leaf, wave and coil spring.

4. A shaft according to claim 1, wherein said hook elements of said at least one first and second couplings being cooperating pairs of diverging and converging complementary hook elements.

5. A shaft according to claim 1, wherein said at least two arcuate leaf elements are three arcuate leaf elements.

6. A shaft according to claim 1, wherein each of said at least two arcuate leaf elements including a plurality of knurls on an outer surface for increasing friction of engagement with a core of a product to be gripped.

7. A shaft according to claim 1, further comprising an air journal removably coupled with said inner body and including an intake opening for permitting air to be supplied to said at least one thrusting element for moving said at least two arcuate leaf elements to said first configuration from said second configuration.

8. A shaft according to claim 7, wherein said air journal further including an exit opening for permitting air to be removed from said at least one thrusting element for moving said at least two arcuate leaf elements to said second configuration from said first configuration.

9. A shaft according to claim 7, wherein said air journal further including at least one locking member engageable with said inner body for imparting rotational torque transmission to said shaft.

10. A shaft according to claim 7, wherein said air journal further including at least one locking member engageable with a journal end connectable to a drive unit for driving said shaft for imparting rotational torque transmission to said shaft.

11. An expansible shaft having an outer profile, said shaft comprising: an inner body having a longitudinal axis and at least one first coupling, each said at least one first coupling being at least one pair of spaced apart longitudinally extending hook elements, each pair defining longitudinally extending walls of a longitudinally extending channel therebetween;

at least two leaf elements being movably coupled to said at least one first coupling of said inner body by means of at least one second coupling, each said at least one second coupling being at least one pair of spaced apart longitudinally extending hook elements complementary to and cooperating with said spaced apart longitudinally extending hook elements of said at least one first coupling to limit radial movement of said at least two leaf elements relative to said inner body, said at least two leaf elements together substantially forming said outer profile of said expansible shaft; and at least one thrusting element being operatively disposed in each longitudinally extending channel and between said at least two leaf elements and said inner body to move said leaf elements radially outwards relative to said longitudinal axis to increase an outer perimeter of said shaft when in a first configuration and allow said at least two leaf elements to move radially inwards relative to said longitudinal axis to decrease said outer perimeter of said shaft when in a second configuration.

12. A shaft according to claim 11, wherein said at least two leaf elements being resiliently biased radially inwards by means of at least one spring disposed between said inner body and said at least two leaf elements.

13. A shaft according to claim 12, wherein each said spring being one of a leaf, wave and coil spring.

14. A shaft according to claim 11, wherein said hook elements of said at least one first and second couplings being pairs of diverging and converging complementary hooks.

15. A shaft according to claim 11, wherein each of said at least two leaf elements including a plurality of knurls on an outer surface for increasing friction of engagement with a core of a product to be gripped.

16. A shaft according to claim 11, further comprising an air journal removably coupled with said inner body and including an intake opening for permitting air to be supplied to said at least one thrusting element for moving said at least two leaf elements to said first configuration from said second configuration.

17. A shaft according to claim 16, wherein said air journal further including an exit opening for permitting air to be removed from said thrusting element for moving said leaf elements to said second configuration from said first configuration.

18. A shaft according to claim 16, wherein said air journal further including at least one locking member engageable with said inner body for imparting rotational torque transmission to said shaft.

19. A shaft according to claim 16, wherein said air journal further including at least one at least one locking member engageable with a journal end connectable to a drive unit for driving said shaft for imparting rotational torque transmission to said shaft.

20. A generally cylindrical expansible shaft having an outer profile, said shaft comprising:

an inner body having a longitudinal axis and at least one first coupling, each said at least one first coupling being at least one pair of longitudinally extending hook elements;

at least two leaf elements being movably coupled to said at least one first coupling of said inner body by means of at least one second coupling, each said at least one second coupling being at least one pair of longitudinally extending hook elements complementary to and cooperating with said longitudinally extending hook elements of said at least one first coupling to limit radial movement of said at least two leaf elements relative to said inner body, said at least two leaf elements together substantially forming said outer profile of said expansible shaft;

at least one thrusting element being operatively disposed between each said at least two leaf elements and said inner body to move said leaf elements radially outwards relative to said longitudinal axis to increase an outer perimeter of said shaft when in a first configuration and allow said at least two leaf elements to move radially inwards relative to said longitudinal axis to decrease said outer perimeter of said shaft when in a second configuration; and at least one spring disposed between said inner body and said at least two leaf elements to resiliently bias radially inward said at least two leaf elements, said at least one spring being disposed between said at least one first and second couplings.

21. An expansible shaft having an outer profile, said shaft comprising:

a generally cylindrical inner body having a longitudinal axis and at least one first coupling, each said at least one first coupling being at least one pair of longitudinally extending hook elements;

at least two arcuate leaf elements being movably coupled to said at least one first coupling of said inner body by means of at least one second coupling, each said at least one second coupling being at least one pair of longitudinally extending hook elements complementary to and cooperating with said longitudinally extending hook elements of said at least one first coupling to limit radial movement of said at least two arcuate leaf elements relative to said generally cylindrical inner body, said at least two arcuate leaf elements together substantially forming said outer profile of said generally cylindrical expansible shaft;

at least one thrusting element being operatively disposed between each said at least two arcuate leaf elements and said inner body to move said at least two arcuate leaf elements radially outwards relative to said longitudinal axis to increase an outer diameter of said shaft when in a first configuration and allow said at least two arcuate leaf elements to move radially inwards relative to said longitudinal axis to decrease said outer diameter of said shaft when in a second configuration; and at least one spring disposed between said inner body and said at least two arcuate leaf elements to resiliently bias radially inwards said at least two arcuate leaf elements, said at least one spring being disposed between said at least one first and second couplings.

* * * * *